US005389212A

United States Patent [19]

McLaren

[11] Patent Number: 5,389,212

[45] Date of Patent: Feb. 14, 1995

[54] METHOD FOR RECOVERING PHOTOGRAPHIC AND INDUSTRIAL WASTE

[76] Inventor: Richard H. McLaren, P.O. Box 1460, Anaconda, Mont. 59711

[21] Appl. No.: 194,876

[22] Filed: Feb. 14, 1994

[51] Int. Cl.[6] ..... C25C 1/00

[52] U.S. Cl. ..... 204/109; 204/111

[58] Field of Search ..... 204/109, 111, 233, 234, 204/267

[56] References Cited

U.S. PATENT DOCUMENTS 3,510,413 5/1970 Lindau ..... 204/109

5,238,543 8/1993 Onlin ..... 204/109

*Primary Examiner*—John Niebling

*Assistant Examiner*—Brendan Mee

*Attorney, Agent, or Firm*—Shlesinger, Fitzsimmons & Shlesinger

[57] ABSTRACT

Exposed photographic or X-ray film is agitated in a warm leaching bath which causes the silver-bearing emulsion to be removed from the film's plastic substrate in the form of a liquid concentrate which is cycled repeatedly through a first electrolytic extractor the cathode of which collects silver granules of approximately 80%-90% purity. The granules are collected and ball milled to approximatley a twenty (20) mesh consistency, and are transferred to a dilute nitric acid bath which converts the silver to a silver nitrate solution. When the solution of a silver nitrate has a neutral pH, it is filtered and subjected to a second electrolytic process which produces silver having a purity of approximately 0.999 fine.

7 Claims, 1 Drawing Sheet

METHOD FOR RECOVERING PHOTOGRAPHIC AND INDUSTRIAL WASTE

BACKGROUND OF THE INVENTION

This invention relates to the recovery and recycling of photographic and industrial waste materials, and more particularly to a method for recovering metalic silver and plastic base materials used in the production of X-ray and photographic films, and the lie.

The public has become more and more aware of the need for protecting our environment against continued deterioration resulting from the accumulation of industrial and domestic waste in our rivers, streams and fields. In its simplest form, such protective steps have included the practice of requiring each household to separate from its trash recyclable paper, and plastic and glass containers. However, more sophisticated waste products, such as for example exposed or "used" photographic and X-ray films, continue to present a problem for two reasons. The emulsion coatings on such films contain significant quantities of silver, and the plastic sheet material, which forms the substrate for the film's associated emulsion or silver-bearing coating is not biodegradable.

Heretofore, efforts have been made to recover and recycle at least portions of film of the type described, but such prior art efforts have involved rather complicated methods and costly apparatus. For example, U.S. Pat. No. 3,510,413 discloses, generally, the method of mixing and agitating film chips in a liquid bath which is designed to remove the emulsion layer from the plastic chips. Thereafter the chips are separated from the liquid bath, and silver is recovered from the bath via an electrolytic process. However, one disadvantage of such prior art process is that the percentage of recovery of the silver is rather poor, and the silver that is recovered is not of very high purity. The U.S. Pat. Nos. 3,793,168 and 4,093,532 also disclose the use of electrolytic processes for recovering silver from the emulsion residue of photographic film, but again, the purity of the recovered silver is not satisfactory.

There are, of course, other methods of recovering silver from waste or used photographic film and the like, see for example U.S. Pat. Nos. 4,299,676 and 3,929,466, but such processes do not utilize an electrolytic process for recovering extremely pure silver in a manner disclosed hereinafter by applicant.

Accordingly, it is an object of this invention to provide an improved, efficient, readily available and inexpensive method of recycling film products of the type described, thus substantially eliminating any ground or atmospheric pollution, which might otherwise result upon the discard of such products.

Still another object of this invention is to provide an improved, alternative method to the known method of disposing of used film by burning the film, a process which releases toxic chemicals into the air by vaporizing the plastic film substrate.

Another object of this invention is to recover and recycle plastics such as MYLAR and like plastic backings which are utilized by X-ray and photographic film, thus enabling reuse of such plastic in photographic and plastic industries.

Still a further object of this invention is to provide an improved process and apparatus which enables recovery from waste photographic and X-ray film, and the lie, silver which has a purity of approximately 0.999 fine, and whereby no toxic metal is released into the atmosphere.

Also, it is an object of this invention to provide an improved method and apparatus for recovering silver and plastics from used photographic film, and the lie, and which are so effective and safe in handling toxic materials, that the method and apparatus would be perfectly suitable for use by hospitals, clinics, and the like.

Other objects of the invention will be apparent hereinafter from the specification, and from the recital of the appended claims, particularly when read in conjunction with the accompanying drawing.

SUMMARY OF THE INVENTION

A batch of used or exposed photographic or X-ray film is placed in a warm leaching bath which is agitated to cause the silver-bearing emulsion to be removed from the surface of the film's plastic substrate. The liquid bath containing the emulsion concentrate is cycled repeatedly through a first electrolytic extractor, the cathode of which collects silver granules of approximately 80%-90% purity. The silver granules from this first electrolytic process are collected and ball milled to approximately a twenty (20) mesh consistency, and then are subjected in batch form to a dilute nitric acid bath which converts the silver to a silver nitrate solution.

When all of the nitric acid in the preceding bath extraction step has been utilized in the exchange process, whereby the solution of silver has a neutral pH, the solution is filtered via Watman paper, and the filtered silver solution is subjected to a second electrolytic process, which produces silver having a purity of approximately 0.999 fine.

THE DRAWING

FIG. 1 is a schematic view illustrating according to one, embodiment of this invention the apparatus and process which are utilized for recovering silver and plastic from photographic film ad the like, most of the illustrated containers being broken away schematically to illustrate the interiors thereof, and broken lines and arrows being utilized in some instances schematically to illustrate the transfer of product from one container to another during performance of the process.

DETAILED DESCRIPTION OF THE PREFERRED EMBODIMENTS

Figure 1:
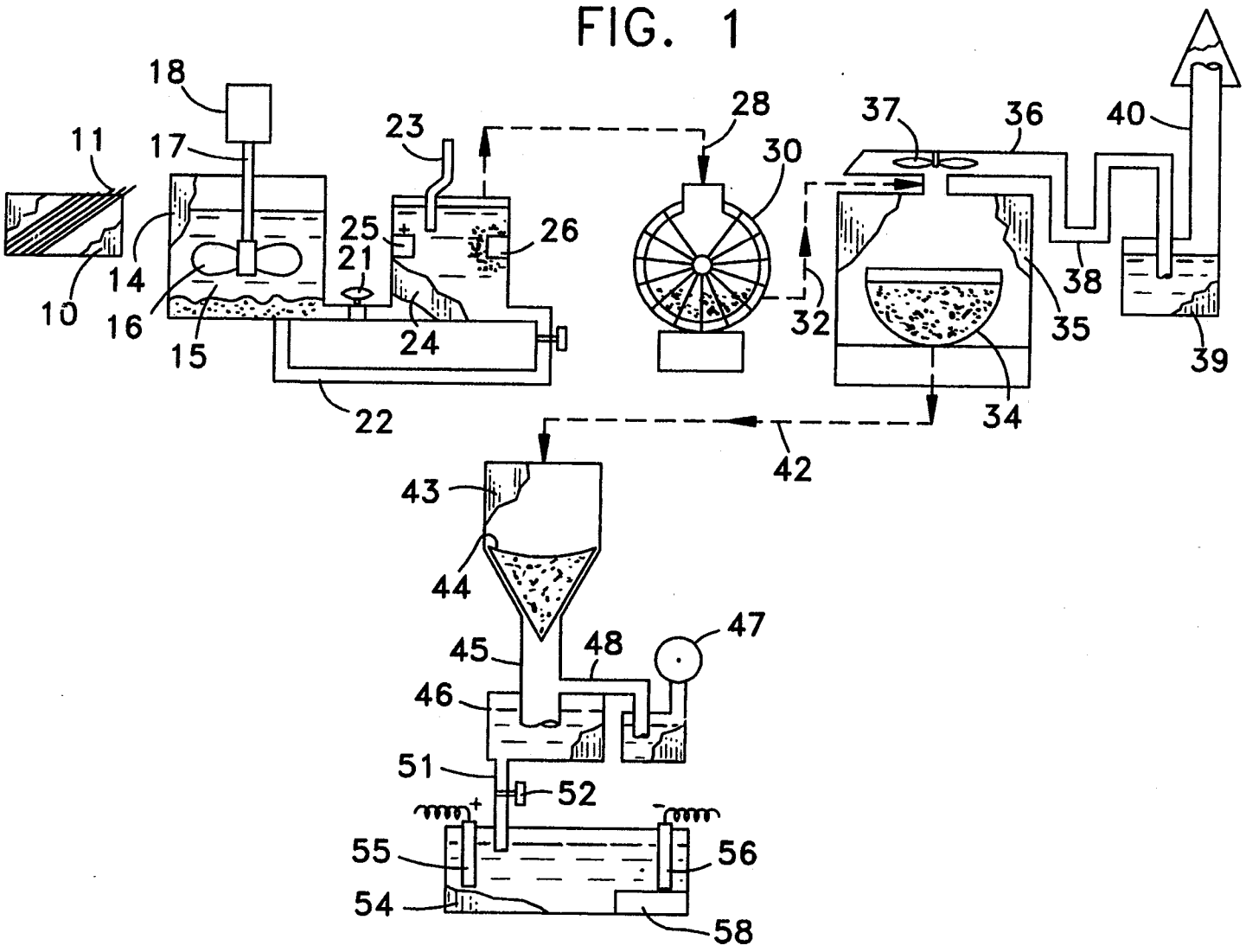

Referring now to FIG. 1 by numerals of reference, 10 denotes a tank or container which can be utilized for retaining a supply of exposed layers or strips 11 of photographic or X-ray film, and the like, which are to be subjected to the recovery process that forms the subject matter of this invention. Strips of film 11 are transferred in any conventional manner from container 10 to a leaching vat or tank 14, which contains a warm, sodium chlorite leaching compound 15 comprising two parts per thousand of sodium hypochlorite NaOCl), which means two parts of concentrated sodium hypochlorite per thousand parts of diluent. In the present example the diluent amounted to twenty gallons of distilled water, which amounts to 8 cc. concentrated sodium hypochlorite per gallon of leaching liquid. This leaching liquid is continuously stirred or agitated by the blades 16, which are supported by the shaft 17 of a conventional agitator 18 that is mounted above tank 14. The leaching liquid 15 is heated to maintain it at a temperature above room temperature, and as a consequence the actual clearing of the silver emulsion from the plastic film substrate or base takes but several minutes within tank 14. In practice, tank 14 and the associated agitator 16 may be in the form of, for example, a commercial clothes washing machine.

The silver emulsion which is removed from the film base collects in the bottom of tank 14 as a batch concentrate; and this batch concentrate is cycled via a pump 21 and a return line 22 from tank 14 through a commercial electrolytic extractor 24, which may be of the type manufactured by X-Rite Corporation of Grandville, Miss. This cycling or circulation of the batch concentrate from tank 14 through the extractor 24 continues until all, or substantially all levels of toxic silver effluent have been removed from the concentrate, as determined, for example, by a dipstick 23, which monitors the silver content of the concentrate in extractor 24. Dipstick 23 may be of the type sold by MNR of West Germany, an which functions to detect silver in solution photo-chemically.

The extractor 24 contains the usual anode 25 and cathode 26, on the latter of which granules of metalic silver accumulate during the cycling of the batch concentrate from tank 14 through tank 24. After the dipstick 23 indicates that the silver content of the cycled batch concentrate has been reduced to the level so that the concentrate is no longer toxic, the cycling of the concentrate is interrupted by stopping pump 21; and the silver granules on cathode 26, which at this stage are 80%–90% pure silver, are removed, by hand if desired. These granules are then transferred as indicated by the broken line and arrow 28, into a ball mill 30 which may be of the type sold by Baxter Supply, McGraw Park, Ill., and identified as U.S. Stoneware c8910-2,8756-2. Ball mill 30 pulverizes the silver granules collected from the cathode 26 to a twenty (20) mesh consistency.

After the 80%–90% silver granules have been pulverized to the desired consistency in ball mill 30, they are transferred, as indicated by a broken line and arrows 32, to a vat 34 containing dilute nitric acid ($HNO_3$). The vat or container 34 is housed in a tank 35, which is covered by a vented hood 36. Hood 36 contains a conventional ventilator or blower 37, which draws toxic fumes and vapors from tank 35 and discharges them through a conventional trap 38 into a water bath in a tank 39. The upper end of tank 39 is vented as at 40 to the atmosphere.

The silver granules that are supplied to vat 34 undergo another extraction process during which the silver in the batch of pulverized granules is converted to silver nitrate ($AgNO_3$). This process generates noxious nitrogen dioxide ($NO_2$) which, by virtue of the vented hood 36, is transferred to the water bath in tank 39. As a consequence, all of the $NO_2$ is retrieved or absorbed in the water bath in tank 39, rather than being released into the atmosphere. The batch extraction process in vat 39 continues until all of the dilute nitric acid is utilized in the exchange process, thereby reducing the resulting batch of silver nitrate to an approximately neutral pH.

After the extraction process has been completed in vat 34, the neutral silver nitrate solution is delivered, as shown by the broken line and arrows at 42, to the inlet of a Buchner-type filter unit 43, which contains a filter element 44 in the form of Watman paper. Unit 43 has an outlet 45 which communicates with a holding tank 46. Filtration through the filter element 44 is effected by a Coors-type vacuum pump 47, which is distributed by McGraw Par Products, of McGraw Park, Ill., and which is connected in Known manner by a conduit 48 with the outlet 45 of the filter element 43. The filtrate entering the holding tank 46 contains ninety-eight to ninety-nine per cent (98%–99%) pure silver in solution. Holding tank 46 has an outlet pipe 51 connected through a control valve 52 with another electrolytic extractor tank 54, which may be a standard device of the type sold by H.B.C. Company of Los Angles, Calif. Extractor 54 contains the usual anode 55 and cathode 56, but has been modified or supplemented by incorporating therein a non-reactive plastic container 58, for example a PVC container, which is positioned beneath cathode 56 to catch and retain small amounts of pure silver which gravitate from the cathode 56 before the extraction by electrolysis is complete. The process itself requires only approximately three amperes of direct current flowing in the electroconveyance solution which is normally used in this type of extractor.

After the extraction process in tank 54 has been completed, the final, pure silver (0.999 fine) is removed in a conventional manner from the collector cathode 56, and is dried, weighed and assayed. The quality of the silver such that it may then be used in the dental, photographic, jewelry and other such industries, or alternatively, it may be compounded as silver nitrate, silver chloride or other salts.

Referring again to tank 14, the plastic film base, which remains in the tank after each batch of concentrate in the tank has completed its extraction cycle through the extractor 24, is removed from tank 14, dried, weighed and shipped to photographic supply manufacturers, and the like, or recycling and reuse.

In view of the foregoing, it will be apparent that the present invention provides relatively simple and inexpensive means for recovering extremely pure quantities of silver from used or waste photographic film, and the like, and without releasing any toxic by-products into the atmosphere. Moreover, use of the novel method taught herein will not only permit the recovery of extremely pure silver, but also will enable recycling and reuse of the plastic film substrate or base which originally was coated with silver-containing emulsion, and the like. Furthermore, the equipment is such that the process can be performed as a relatively simple batch process in hospitals, clinics, and other such places where the recovery of silver would be desirable, but which also require strict environmental protection controls.

Moreover, while this invention has been illustrated and described in detail in connection with only certain embodiments thereof, it will be apparent that it is capable of still further modification, and that this application is intended to cover any such modifications as may fall within the scope of one skilled in the art, or the appended claims.

I claim:

1. A process for recovering from the silver-bearing emulsion of used photographic and X-ray films, metallic silver having a purity on the order of 0.999 fine, comprising placing in a tank, which contains a mixture of warm water and a silver emulsion leaching agent, a supply of used photographic or X-ray film, agitating said mixture and the used film in said tank to cause the emulsion to be removed from the plastic substrate of the film, and to form a concentrate in said tank, cycling said concentrate through a first electrolytic extractor to produce a first batch of silver granules having a purity less than 0.999 fine, pulverizing said first batch of granules, and transferring the pulverized granules to an acid bath to form a silver salt solution having an approximately neutral pH, and transferring said salt to a second electrolytic extractor operable to produce a second batch of silver granules having a purity on the order of 0.999 fine.

2. A process as defined in claim 1, wherein said leaching agent comprises concentrated NaOCl in an amount of two parts per thousand of said warm water.

3. A process as defined in claim 1, including monitoring the silver content of said concentrate during the cycling thereof through said first electrolytic extractor, and continuing said cycling until substantially all toxic silver has been removed from said concentrate by said first extractor.

4. A process as defined in claim 1, wherein said acid bath comprises dilute nitric acid operative to convert the silver in said first batch of granules to silver nitrate.

5. A process as defined in claim 4, including retaining said first batch of said granules in said acid bath until the bath reaches an approximately neutral pH.

6. A process as defined in claim 1, including exhausting gas and vapors from said acid bath through a water bath to the atmosphere.

7. A process as defined in claim 1, including passing said silver salt through a filter element during transfer of salt from said acid bath to said second extractor.

* * * * *